US009821983B2

(12) United States Patent
Billard et al.

(10) Patent No.: US 9,821,983 B2
(45) Date of Patent: Nov. 21, 2017

(54) ELEVATOR BRAKING DEVICE

(75) Inventors: Justin Billard, Amston, CT (US); James M. Draper, Woodstock, CT (US); Anthony Cooney, Unionville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1171 days.

(21) Appl. No.: 13/509,288

(22) PCT Filed: Dec. 23, 2009

(86) PCT No.: PCT/US2009/069392

§ 371 (c)(1),
(2), (4) Date: May 11, 2012

(87) PCT Pub. No.: WO2011/078862

PCT Pub. Date: Jun. 30, 2011

(65) Prior Publication Data

US 2012/0222918 A1 Sep. 6, 2012

(51) Int. Cl.
*B66B 5/18* (2006.01)
*B66B 5/22* (2006.01)

(52) U.S. Cl.
CPC ..... *B66B 5/22* (2013.01)

(58) Field of Classification Search
CPC ..... B66B 5/22; B66B 5/24
(Continued)

(56) References Cited

U.S. PATENT DOCUMENTS 3,509,970 A 5/1970 Gabler
4,176,826 A * 12/1979 Gray et al. ..... 188/189
(Continued)

FOREIGN PATENT DOCUMENTS

JP S4991055 U 8/1974
JP 59-5021 2/1984
(Continued)

OTHER PUBLICATIONS

First Search for Chinese Patent Application No. 200980163162.4 dated Dec. 11, 2013.
(Continued)

*Primary Examiner* — Michael A Riegelman
(74) *Attorney, Agent, or Firm* — Carlson, Gaskey & Olds

(57) ABSTRACT

An exemplary elevator braking device comprises a brake housing. A plurality of rollers are supported by the brake housing. The rollers are arranged to be positioned on opposite sides of a guiderail. The rollers are selectively moveable between a first position in which the rollers are spaced apart a first distance and a second position in which the rollers are spaced apart a second, smaller distance so that the rollers engage and roll along opposite sides of the guiderail. At least one biasing member is supported by the brake housing. The biasing member is associated with at least one of the rollers and biases the associated roller toward the other roller in the second position. A plurality of braking surfaces are supported by the brake housing. At least one braking surface is associated with each of the rollers. Each braking surface engages a periphery of the associated roller that faces the side of the guiderail. Friction between the periphery of the associated roller and the braking surface provides a stopping force.

20 Claims, 3 Drawing Sheets

(58) Field of Classification Search
USPC ..... 187/359, 376
See application file for complete search history.

(56) References Cited

U.S. PATENT DOCUMENTS

| | | | | |
|---|---|---|---|---|
| 4,538,706 | A * | 9/1985 | Koppensteiner | 187/376 |
| 5,002,158 | A * | 3/1991 | Ericson et al. | 187/254 |
| 5,964,322 | A * | 10/1999 | Thompson et al. | 188/251 M |
| 6,109,398 | A | 8/2000 | Lempio et al. | |
| 6,318,507 | B1 | 11/2001 | Jin | |
| 6,997,287 | B2 | 2/2006 | Sasaki | |
| 7,398,863 | B2 | 7/2008 | Liebetrau et al. | |
| 8,186,483 | B2 * | 5/2012 | Sirigu et al. | 187/366 |
| 2002/0125079 | A1 * | 9/2002 | Mattlar et al. | 187/375 |
| 2008/0296098 | A1 | 12/2008 | Sato et al. | |

FOREIGN PATENT DOCUMENTS

| | | | |
|---|---|---|---|
| KR | 200401386 | Y1 | 11/2005 |
| WO | 2004033354 | A1 | 4/2004 |

OTHER PUBLICATIONS

International Search Report and Written Opinion of the International Searching Authority for International Application No. PCT/US2009/069392 dated Aug. 25, 2010

International Preliminary Report on Patentability for International application No. PCT/US2009/069392 dated Jul. 5, 2012.

Extended European Search Report for European Application No. 09852683.3, dated Oct. 12, 2015.

* cited by examiner

ELEVATOR BRAKING DEVICE

BACKGROUND

Elevator systems typically include a car that moves along guiderails within a hoistway between different levels in a building. A variety of machine configurations are used to move the car as desired. Various braking arrangements are used to maintain the elevator car at a desired landing.

Another feature typical of elevator systems is a safety braking arrangement. A governor device typically detects an overspeed condition and activates a safety braking device that is mounted on an elevator car or counterweight, for example. A safety braking device typically applies a braking force to the guiderail to decelerate the car or counterweight and bring it to a stop. One example arrangement is shown in U.S. Pat. No. 4,538,706. As shown in that document, a brake pad is forced against a surface of the guiderail during a brake application.

One attempt at avoiding applying a braking force to the guiderail surface is shown in the published application WO 2004/033354. In that document, brake pads apply a braking force to the sides of rollers that are disposed on opposite sides of the guiderail.

SUMMARY

An exemplary elevator braking device comprises a brake housing. At least one roller is supported by the brake housing. The roller is arranged to be selectively moveable between a first position in which the roller does not engage a guide rail and a second position in which the roller can engage and roll along the guide rail. At least one biasing member is supported by the brake housing. The biasing member biases the roller toward the guide rail. At least one braking surface is supported by the brake housing. The braking surface engages a periphery of the roller that faces the side of the guiderail. Friction between the periphery of the associated roller and the braking surface provides a stopping force.

An exemplary method of decelerating a vertically moving mass in an elevator system includes providing at least one braking device on the vertically moving mass. The braking device has at least one roller that engages a surface of the guiderail. The roller is biased toward the guiderail. The roller is permitted to roll along the guiderail without sliding along it. A braking force is applied to a periphery of the roller that faces the guiderail using at least one braking surface that engages the periphery of the roller.

The various features and advantages of the disclosed examples will become apparent to those skilled in the art from the following detailed description. The drawings that accompany the detailed description can be briefly described as follows.

DETAILED DESCRIPTION

Figure 1:
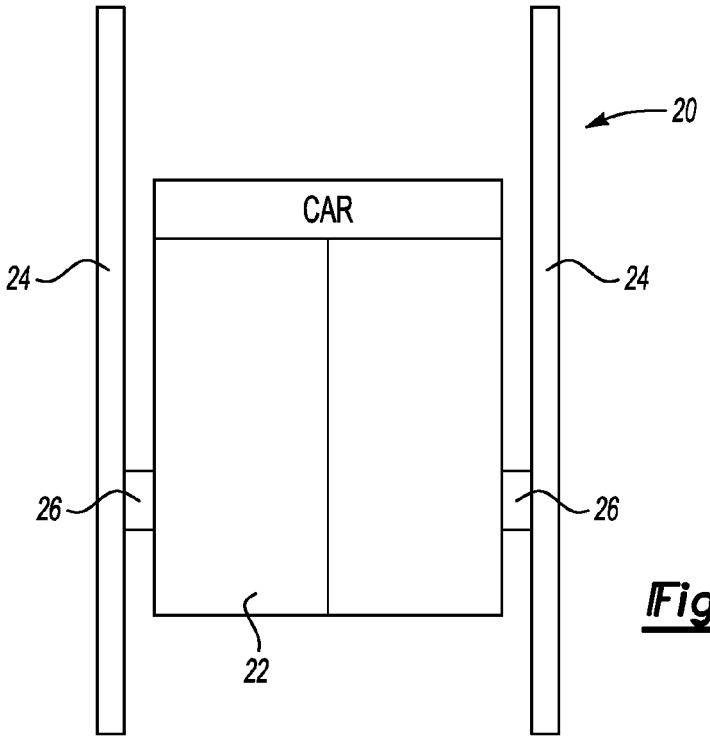
FIG. 1 schematically shows selected portions of an elevator system.

FIG. 1 schematically shows selected portions of an elevator system 20. An elevator car 22 is supported for vertical movement within a hoistway along guiderails 24. Braking devices 26 are supported on the car to selectively prevent vertical movement of the car along the guiderails 24. One feature of the braking devices 26 is that they do not have any components (such as a brake pad) that slide along the guide rails 24. The energy of the descending elevator car 22 is dissipated through friction that is internal to the braking device 26. Using internal friction for stopping the car provides a more robust braking device because any variation in the coefficient of friction along the rail, which could result from lubricants, moisture, rust, or debris, for example, does not have an effect on the coefficient of friction used to stop the elevator car 22 from moving.

Figure 2:
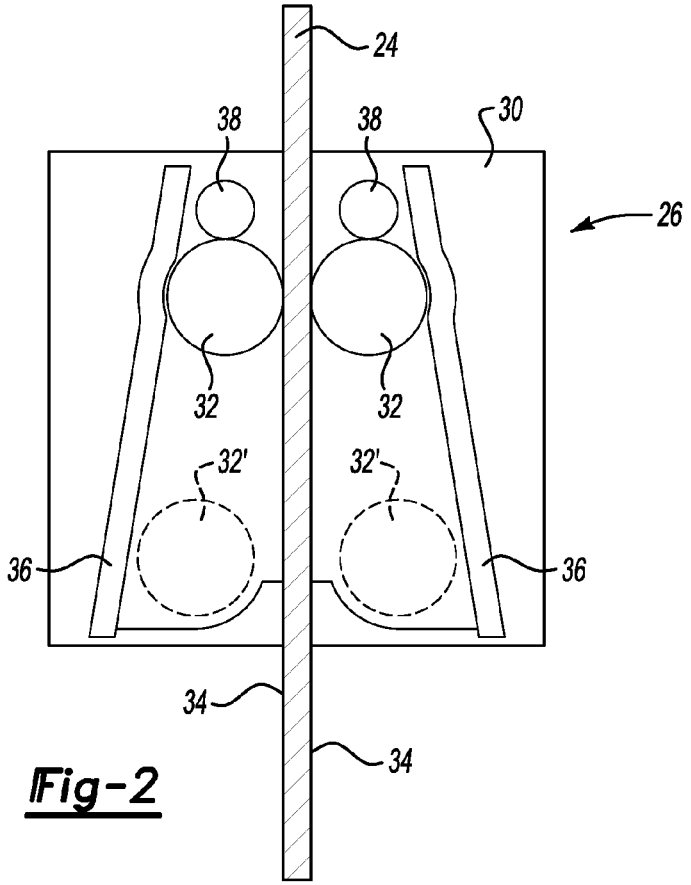
FIG. 2 schematically shows an example elevator braking device designed according to an embodiment of this invention.

FIG. 2 illustrates one example braking device 26. This example includes a housing having a base 30 that is configured to be mounted to an appropriate portion of the elevator car 22. A plurality of rollers 32 are supported by the base 30. The rollers 32 are received on opposite sides 34 of the guiderail 24. The rollers 32 in this example are selectively moveable between a first position (shown in phantom at 32') in which the rollers do not engage the guiderail 24 and a second position (shown in FIG. 2) in which the rollers 32 engage the sides 34 of the guiderail 24. As can be appreciated from the illustration, when the rollers 32 are in the first position 32' they are spaced apart a first distance. A second, smaller distance is between the rollers 32 when they are in the second position.

The example of FIG. 2 includes biasing members 36 that bias the rollers 32 toward each other at least in the second position. The biasing force of the biasing members 36 urges the rollers 32 into engagement with the surfaces 34 on the guiderail 24. The biasing force also serves to achieve appropriate frictional forces within the device 26 for applying a braking force to stop movement of the elevator car 22.

The example of FIG. 2 includes braking members 38 having braking surfaces that engage a periphery of the rollers 32 that faces the guiderail surface 34. Applying a frictional force to the periphery of the rollers 32 achieves a braking force sufficient to stop the elevator car from continuing to move vertically at an undesired speed. In one example, the braking members 38 remain fixed relative to the base 30.

Figure 3:
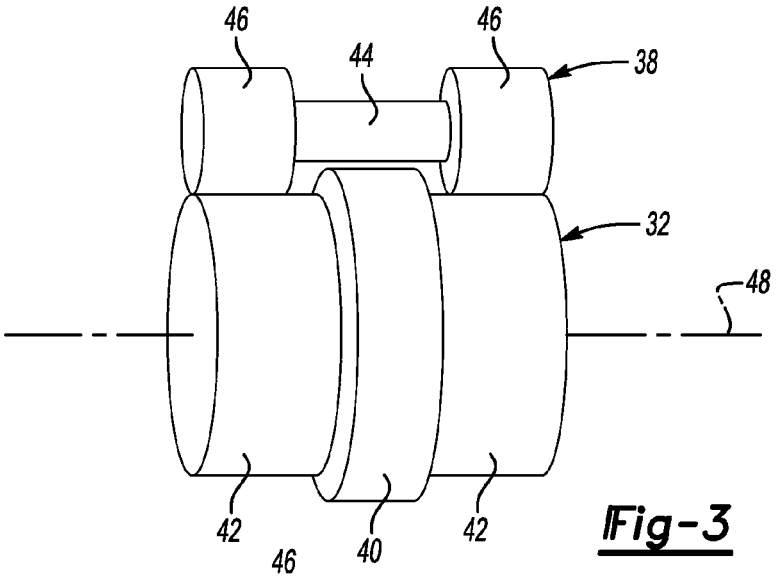
FIG. 3 illustrates an example roller and braking member configuration.

FIG. 3 shows one example arrangement in which the rollers 32 each include a first portion 40 and a second portion 42. In this example, the first portion 40 has a larger outside diameter compared to that of the second portion 42. The first portion 40 contacts the surface 34 on the guiderail 24. The braking member 38 in this example includes corresponding portions 44 and 46. The portions 46 only engage the surfaces of the periphery of the roller 32 at the second portion 42. The portion 44 of the braking member 38 does not contact the first portion 40 of the roller 32. The braking force applied due to the frictional engagement between the second portion 42 and the portion 46 of the roller 38 provides the braking force for stopping vertical movement of the elevator car 22. The first portion 40 rolls along but does not slide on the surface 34 of the guiderail 24.

In one example, the biasing members 36 each have a contour corresponding to shape of the periphery of the rollers 32 so that the biasing members 36 do not engage the portion 40 but does engage the portion 42. This allows for applying braking force by the biasing members 36, for example.

As can be appreciated from FIG. 3, the peripheral surface of the roller 32 that engages the braking surfaces is parallel to an axis of rotation 48 about which the roller 32 rotates.

Figure 4:
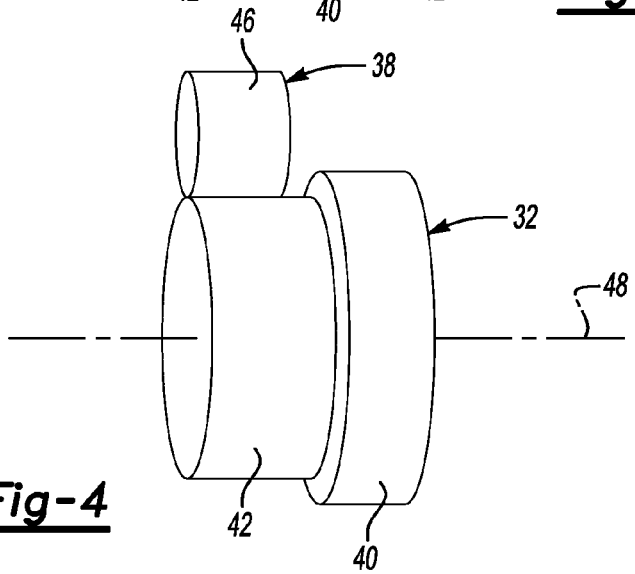
FIG. 4 illustrates another example roller and braking member configuration.

FIG. 4 illustrates another example in which the first portion 40 of the roller 32 is positioned near one end of the roller with the second portion 42 positioned near another end of the roller 32. In the example of FIG. 3, the first portion is located between the second portions 42 of the roller 32. In the example of FIG. 4 the braking member 38 is simplified compared to the configuration shown in the example of FIG. 3 because there is no requirement for a reduced diameter portion 44, which accommodates the first portion 40, between larger sized portions 46.

Figure 5:
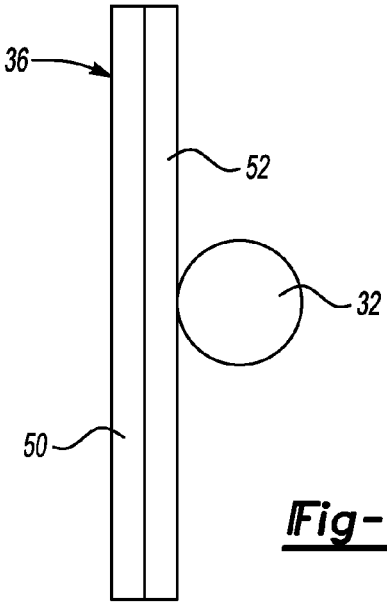
FIG. 5 illustrates an example biasing member configuration.

FIG. 5 illustrates an example configuration in which the biasing member 36 comprises a leaf spring. In this example, a leaf spring base material 50 constitutes a portion of the biasing member 36. A frictional surface material 52 is provided on one side of the leaf spring that faces and engages the periphery of the roller 32. This example allows for providing a braking force using the engagement between the roller 32 and the biasing member 36. As shown in the example of FIG. 2, braking surfaces can be used on the biasing members 36 and the braking member 38 to achieve a desired braking force.

Figure 6:
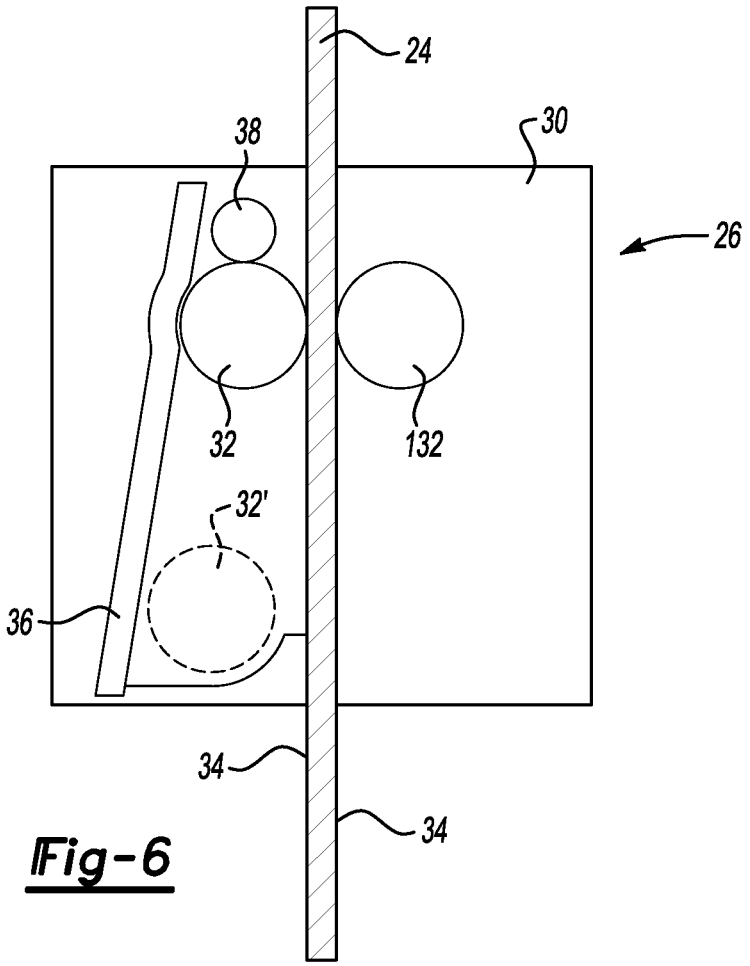
FIG. 6 illustrates another example braking device embodiment.

FIG. 6 illustrates another example braking device 26. In this example, one roller 32 engages at least one braking surface internal to the braking device for stopping the elevator car 22. Another roller 132 is provided that is essentially free-wheeling for rolling, without sliding, along the guide rail 24. The braking forces are applied in this example without relying upon any frictional engagement between the roller 132 and a braking surface internal to the braking device.

Another example includes having the roller 132 has a corresponding braking surface internal to the braking device. The roller 132 is this example remains in a single vertical position relative to the base and engages the guiderail when the braking device 26 (and the elevator car) shifts laterally responsive to the roller 32 engaging the guide rail.

One feature of the illustrated examples is that they provide a progressive safety device. The resilience of the biasing members 36 (e.g., leaf springs or another resilient member) and the presence of the rollers 32 on opposite sides of the guiderail 24 allows for progressively applying a braking force as the rollers 32 are urged further toward the second position.

The illustrated examples avoid the drawbacks associated with attempting to apply a braking force to a guiderail surface. A variety of actuating arrangements including known governor configurations are useful for moving the rollers 32 between the first and second positions for a brake application using the example elevator braking device arrangements.

The preceding description is exemplary rather than limiting in nature. Variations and modifications to the disclosed examples may become apparent to those skilled in the art that do not necessarily depart from the scope of legal protection given to this invention, which can only be determined by studying the following claims.

We claim:

1. An elevator braking device comprising:

a brake housing;

at least one roller supported by the brake housing, the roller being selectively moveable between a first position in which the roller does not engage a guide rail and a second position in which the roller engages and rolls along the guide rail;

at least one biasing member supported by the brake housing, associated with the at least one roller and biasing the roller toward the guide rail in the second position; and at least one braking surface supported by the brake housing and engaging a periphery of the roller that faces the guide rail such that friction between the periphery of the roller and the braking surface provides a stopping force for stopping vertical movement of an associated elevator car or counterweight.

2. The device of claim 1, wherein the biasing member is deformable responsive to the roller moving into the second position.

3. The device of claim 2, wherein the biasing member includes at least a portion of the braking surface.

4. The device of claim 2, wherein the biasing member comprises a leaf spring.

5. The device of claim 1, comprising at least one braking member supported in the housing and comprising at least a portion of the braking surface.

6. The device of claim 5, wherein the roller periphery has a first portion that engages a side of the guide rail and a second portion that engages the braking surface.

7. The device of claim 6, wherein the first portion of the roller periphery has a first outside diameter and the second portion has a second, smaller outside diameter such that only the first portion engages the guide rail and wherein the braking surface only engages the second portion.

8. The device of claim 5, wherein the at least one braking member comprises a cylindrical braking member having a contour corresponding to a contour of the roller periphery.

9. The device of claim 8, wherein the cylindrical braking member is supported by the housing such that the cylindrical braking member is fixed relative to the housing.

10. The device of claim 5, wherein the at least one biasing member has a countour corresponding to a contour of the roller periphery.

11. The device of claim 1, comprising a plurality of rollers supported by the brake housing and arranged to be positioned on opposite sides of the guide rail, the rollers being selectively moveable between the first position in which the rollers are spaced apart a first distance and the second position in which the rollers are spaced apart a second, smaller distance so that the rollers can engage and roll along opposite sides of the guide rail.

12. The device of claim 11, wherein the at least one biasing member biases each of the rollers toward a corresponding side of the guide rail in the second position.

13. The device of claim 11, comprising at least one braking surface associated with each of the rollers, each braking surface engaging a periphery of the associated roller that faces the side of the guide rail such that friction between the periphery of the associated roller and the braking surface provides the stopping force.

14. A method of decelerating a vertically moving mass in an elevator system, comprising the steps of:

providing at least one braking device on the vertically moving mass, the braking device having at least one roller that engages a surface of a guide rail;

biasing the roller toward the guide rail;

permitting the roller to roll along the guide rail without sliding along the rail; and applying a braking force to a periphery of the roller that faces the surface of the guide rail using at least one braking surface that engages the periphery of the roller, the braking force providing a stopping force to stop vertical movement of the mass.

15. The method of claim 14, comprising providing the braking surface on a biasing member that biases the roller toward the guide rail.

16. The method of claim 15, wherein the roller peripheries each include a first portion that engages only the guide rail and a second portion that engages only the braking surface.

17. The method of claim 14, wherein the roller peripheries each include a first portion that engages only the guide rail and a second portion that engages only the at least one braking surface.

18. The method of claim 14, comprising progressively increasing the applied braking force.

19. The method of claim 14, wherein the braking device comprises a plurality of rollers and at least one of the rollers is on each of oppositely facing surfaces on the guide rail, each of the rollers is biased toward the guide rail and the braking force is applied to each of the rollers.

20. The method of claim 14, comprising providing the braking surface on a braking member that is supported by a housing that supports the rollers.

* * * * *